US008780009B2

(12) United States Patent
Crowley et al.

(10) Patent No.: US 8,780,009 B2
(45) Date of Patent: Jul. 15, 2014

(54) ADJUSTABLE SPIRAL ANTENNA FOR PORTABLE USE

(75) Inventors: Robert J. Crowley, Sudbury, MA (US); Desiree L. Fyler, Needham, MA (US)

(73) Assignee: RF Venue, Ashland, MA (US)

( * ) Notice: Subject to any disclaimer, the term of this patent is extended or adjusted under 35 U.S.C. 154(b) by 435 days.

(21) Appl. No.: 13/066,365

(22) Filed: Apr. 13, 2011

(65) Prior Publication Data

US 2011/0248894 A1 Oct. 13, 2011

Related U.S. Application Data

(60) Provisional application No. 61/342,357, filed on Apr. 13, 2010.

(51) Int. Cl.
*H01Q 1/36* (2006.01)

(52) U.S. Cl.
USPC ..... 343/895; 343/702

(58) Field of Classification Search
USPC ..... 343/702, 895, 880, 705, 708
See application file for complete search history.

(56) References Cited

U.S. PATENT DOCUMENTS 2,763,003 A * 9/1956 Harris ..... 343/895
4,068,238 A * 1/1978 Acker ..... 343/895

* cited by examiner

*Primary Examiner* — Karl D Frech
(74) *Attorney, Agent, or Firm* — Don Halgren

(57) ABSTRACT

A spiral, helical antenna is configured to produce a generally circular polarized radiation pattern covering a range of frequencies, over a ground plane. The antenna is comprised of a spring-like spiral conductor that may be held in compression by a size and shape regulating outer nonconductive membrane. The assembly may be compressed and or extended to adjust the antenna for best performance in a particular situation. The assembly may be compressed into a generally flattened state for storage and or transportation, and extended at a later time for use. Accurate antenna dimensions and good performance are afforded by the use of high quality spring materials in conjunction with precise membrane dimensions.

12 Claims, 6 Drawing Sheets

ADJUSTABLE SPIRAL ANTENNA FOR PORTABLE USE

BACKGROUND OF THE INVENTION

1. Field of the Invention

This invention relates to antennae, and more particularly to compressible spiral antennae, and is based upon Provisional Application Ser. No. 61/342,357, filed 13 Apr. 2010, and which is incorporated herein by reference in its entirety.

2. Prior Art Discussion

Helical antennas are known in the art for relatively simple construction and good gain characteristics, and for their circular polarization properties. Various loop and spiral antennas are made using cylindrical forms, or formed to maintain shape in free space using rigid materials. Collapsible antennas are known in the art. Generally, antennas that are deployed tend to be heavy, rigid and massive, owing to the design need to maintain accurate dimensions. In the antenna art, element sizes are often critical, diameters must be accurate, and the pitch of a helical antenna must have the correct spacing for optimal operation. For these reasons, rigid and or heavy materials are typically used for the conductors, or the conductors, which can be wire, flat wire, conductive tape etc. are supported by a rigid forms.

It would be desirable if less massive antennas of the helical variety could be produced that were lightweight, easily compressed into a flat shape, yet deployable at will, and instantly achieve and maintain necessary dimensions for proper operation. Many uses would be found for the successful adjustable, collapsible helical antenna in situations requiring fast set up and use, safety and or lack of damage to people and objects should the antenna fall from its mounting position, and if the antenna produced a circularly polarized response pattern over a relatively large bandwidth. Concerts, road show crews, audio-visual companies, and others who must quickly and safely set up lights, wireless microphones, stage equipment and the like would benefit, and their safety could be enhanced while affording better wireless coverage with less weight, mass and setup time.

BRIEF SUMMARY OF THE INVENTION

The invention comprises a helical type antenna affixed to a backplane, which may be conductive, that is wound from spring type material that may be compressed with the addition of a shape and dimension holding cover. In one embodiment, the cover is a fabric sock with a skirt that is placed in tension over the helical spring that is put in compression, forming a rigid and stable assembly. In another embodiment, the cover is assisted with a cap to rest upon the end of the coil spring, further stabilizing it, and providing a central attachment point for another tension member that may pass through the center of the coil, such as a string or rope. In one aspect, the rope and sock work together to assure a stable and repeatable dimension for the internal conductors. In another aspect, the coiled conductor is attached at various points in, on, or around the sock. In one embodiment, the conductive backplane is a rigid material having screws therethrough to hold firmly the base of the coil. In another embodiment, the backplane is of a nonconductive plastic or fiber material that is back by a conductive foil. In one aspect, a feedpoint for the antenna is comprised of a movable, flexible elastic conductor. In another aspect, the feedpoint of the antenna is enhanced with the use of a ferrite choke placed a distance from the feedpoint. In another aspect, a holding device maintains the compressed, collapsed state of the helical antenna for storage, and permits quick release.

In the drawings, component and feature numbers generally refer to like components regardless of drawing number.

The invention thus comprises a helical, circularly-polarized antenna assembly having a directional characteristic, comprising a backplane, a compression spring-form helical radiator, and a tensioned cover, whereby the tensioned cover is effective to compress and limit the spring-form helical radiator to a predetermined position during use. The compressive cover may be a fabric cover. The antenna assembly may be further compressed manually from the stable compressed state to a compact storage state. The compression spring form radiator is preferably tapered. The assembly has an operating frequency of between about 450 to about 700 MHz. The invention also comprises a feedpoint arrangement for the mechanically flexible attachment and impedance matching of a helical circularly polarized antenna above a fixed backplane, comprising; an extended end of a coil form defining the radiating element held at various inclined positions relative to the fixed backplane, an insulating sleeve coaxially positioned over the extended end, and, a first open flexible sleeve coaxially positioned over the insulating sleeve, and a fixed radiofrequency feedpoint attached to a second end of said flexible sleeve. The sleeve is preferably a braided sleeve. The mechanically flexible attachment maintains electrical continuity throughout its range of motion. The various inclined positions are accomplished by a first predetermined stable operating position, and a second manually compressed state.

The invention also comprises a helical, circularly-polarized antenna assembly having a directional characteristic, comprising a backplane, a compression spring-form helical radiator, and a tensioning device, whereby the tensioning device is effective to limit the spring-form helical radiator to a predetermined position during use.

BRIEF SUMMARY OF THE DRAWINGS

The objects and advantages of the present invention will become more apparent when viewed in conjunction with the following drawings in which.

DETAILED DESCRIPTION OF THE DRAWINGS

Figure 1:
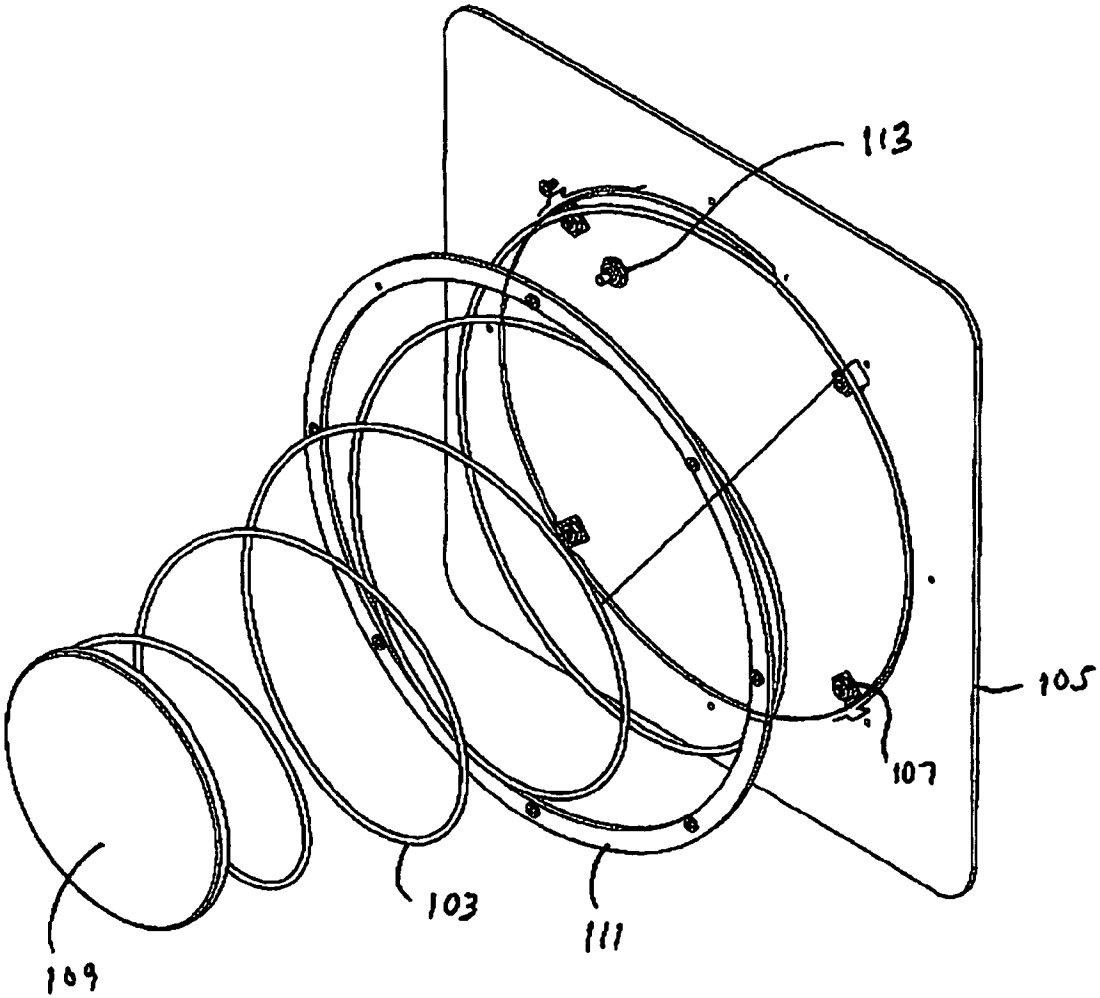
FIG. 1 is a perspective view of the helical spring like antenna with backplane and cap.

Referring now to FIG. 1, the perspective view of the helical springlike antenna and compression sock with backplane and cap, spring 103, wound of a conductive material such as steel, spring stainless steel, or nickel titanium alloy. As can be seen in 103, the coil may be tapered and have a pitch, or distance between each spiral. Such an arrangement of a tapered spiral is known to have properties as a circularly polarized antenna element. Spring 103 may be attached to backplane 105 using clips 107 spaced around the periphery of the spring base, which may be made in a full circle. Such full circle termination of the tapered spiral is not generally used in the antenna art. Tip cap 109 may be attached or placed at the apex of the spiral, which is truncated, to provide a generally flat surface, and to provide an end capacitance, or loading effect, due to the dielectric loading phenomenon, which can enhance and tune the operation of the spiral shaped antenna for optimal performance. Compression collar 111 is shown partially exploded and is sized to fit over the diameter of the circular base of spring 103. BNC connector 113 is screwed through backplane and is shown unterminated in FIG. 1.

Figure 2A:
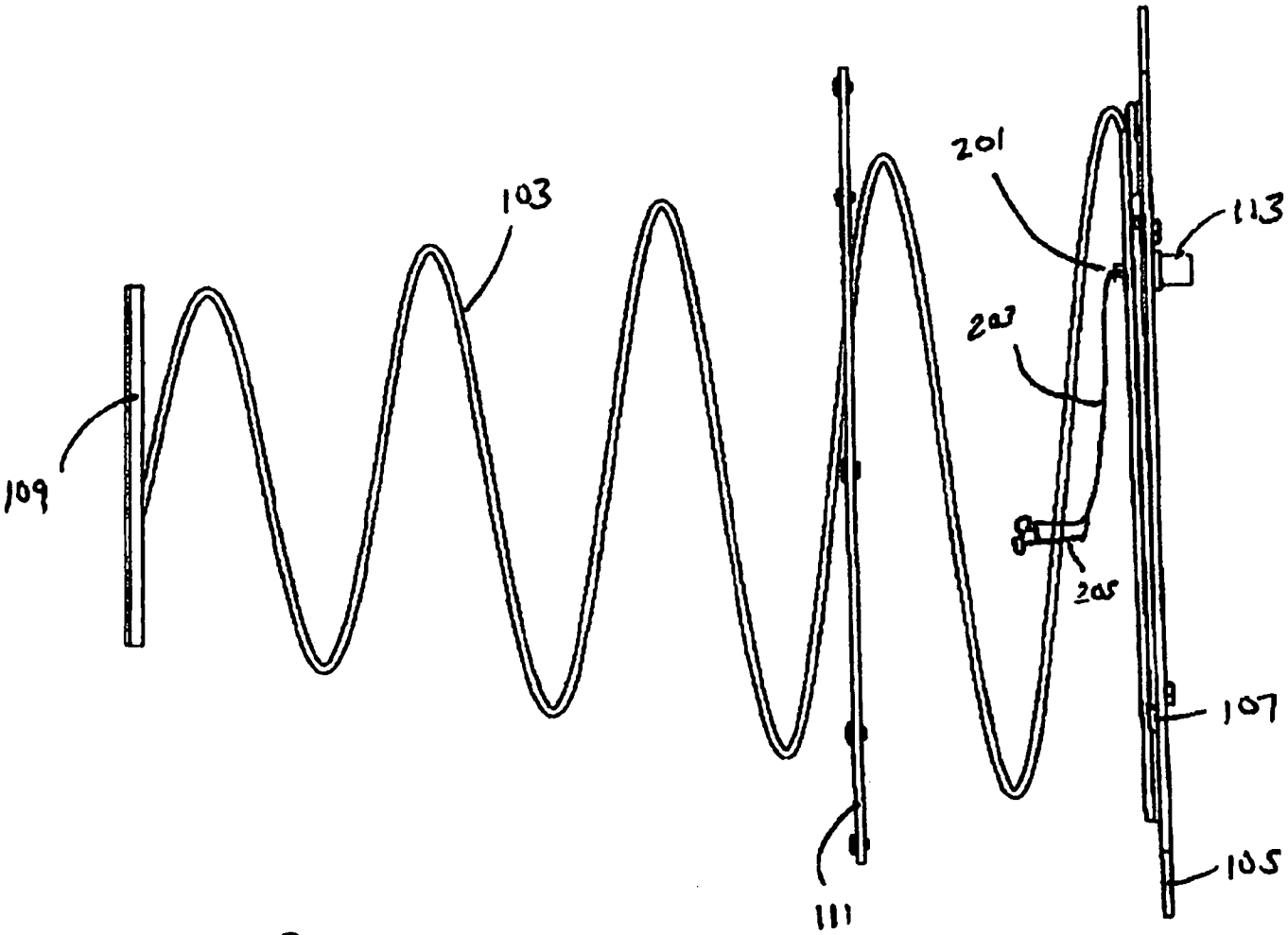
FIG. 2*a* is a side view of the helical spring like antenna with backplane and cap, showing feedpoint details.
Figure 2B:
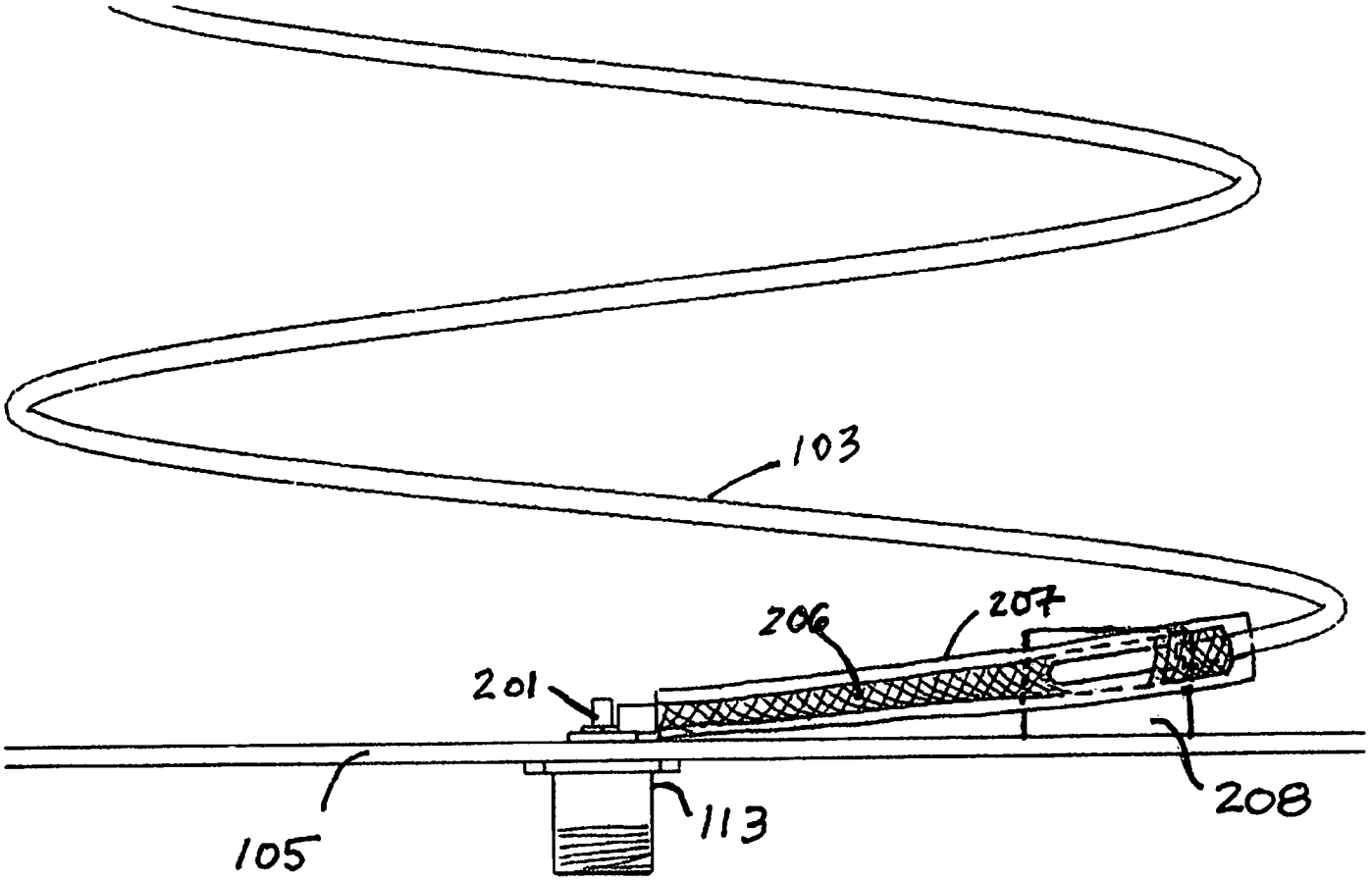
FIG. 2*b* is a closer side view of a feedpoint of the present invention.

Referring now to FIG. 2 a side view of the helical springlike antenna with backplane and cap, showing feedpoint details, spring 103, is electrically connected to BCN connector 113 at terminal 201 with flexible wire 203, which is soldered into place and is comprised of a flexible wire and preferably a very durable and flexible spring such as made of nickel titanium alloy, with one end terminated into a clamp 205, which permits adjustable attachment of flexible wire 203 to spring 103, and affords the assembler with a tunable, adjustable feedpoint mechanism that has flexibility and the ability to return to shape after being compressed. Still referring to FIG. 2, tip cap 109 can be seen to be generally parallel and offset from the plane defined by backplane 105. The backplane material may be a metal, such as aluminum sheet, or another material such as plastic, with an additional conductive surface such as aluminized cloth or foil (not shown). The distance relationship of these surfaces is important to the operation of the invention. FIG. 2*b* shows another tunable feed point that also permits a reliable return to position after compression. A metal braided sleeve 206 is covered with an electrically insulated jacket 207, the braided sleeve 206 being electrically connected to BNC connector 113. A portion of the spring 103 is inserted into the metal braided sleeve 206. The wire braid length and spring insertion length may be adjusted for performance. An insulating spacer 208 is used to insulate the spring 103 from the back plane 105.

Figure 3:
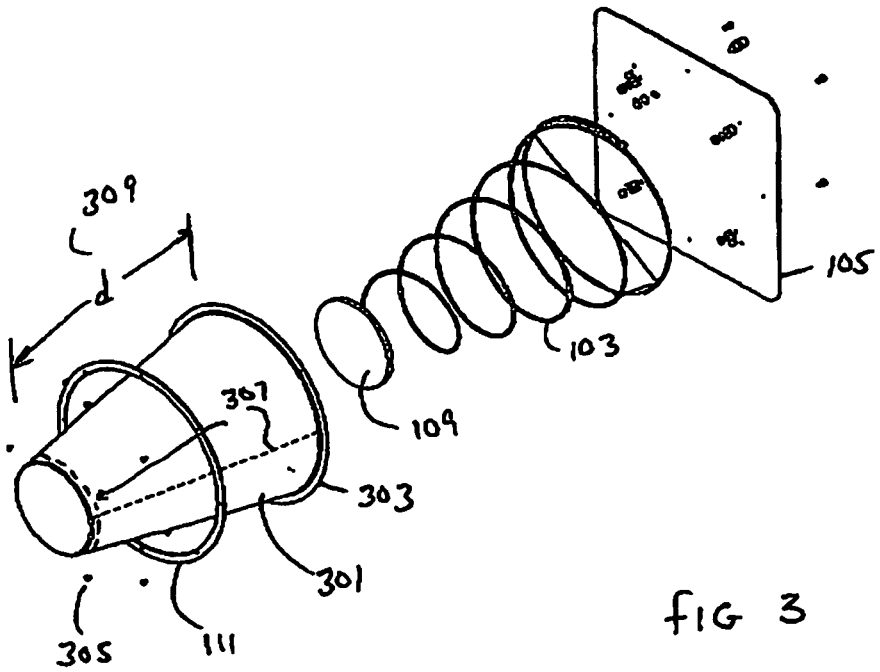
FIG. 3 is an exploded view of the helical spring like antenna showing the relationship of spring compression and cover tensioned components.

Now referring to FIG. 3, an exploded view of the helical springlike antenna showing the relationship of spring compression and cover tensioned components, spring 103, shown in here in a relaxed state, may be compressed by fabric cover 301. Fabric cover 301 may be comprised of sewn cloth, such as nylon cloth, using ordinary thread with seams 307 forming a flexible but relatively inelastic cover with a skirt 303 that can be captured and held onto backplane 105 using a peripheral ring-like compression collar 111, when screwed down by screws 305. When fabric cover 301 is assembled and it compresses spring 103 from its relaxed state to a compressed state, a stable, dimensionally predetermined and compressible assembly is formed that will return to a predetermined length relationship 309 "L" between backplane 105 and tip cap 109, resulting in a helical antenna with accurate dimensions and good performance, even after storage, distortion or compression. In some instances tip cap 109 may be omitted if the end of spring 103 is formed as a complete or near complete circle similar to the circular base shown at the larger end of spring 103.

Figure 4A:
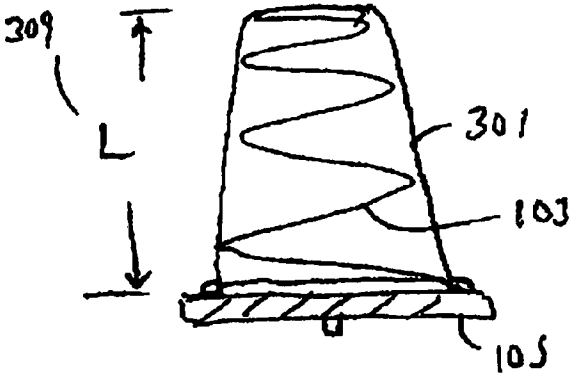
FIG. 4*a* is a cross sectional side view of the assembled helical antenna in an erect state.

Referring now to FIG. 4*a*, a cross sectional side view of the assembled helical antenna in an erect state, one can see that backplane 105 and tensioned fabric cover 301 are connected defining length relationship 309 L, the spring 103 being held in a compressed state determined by the dimensions of fabric cover 301.

Figure 4B:
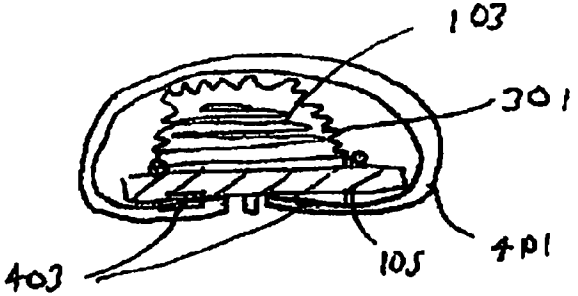
FIG. 4*b* is a cross sectional side view of the assembled helical springlike antenna a collapsed state held with a holding device.
Figure 4C:
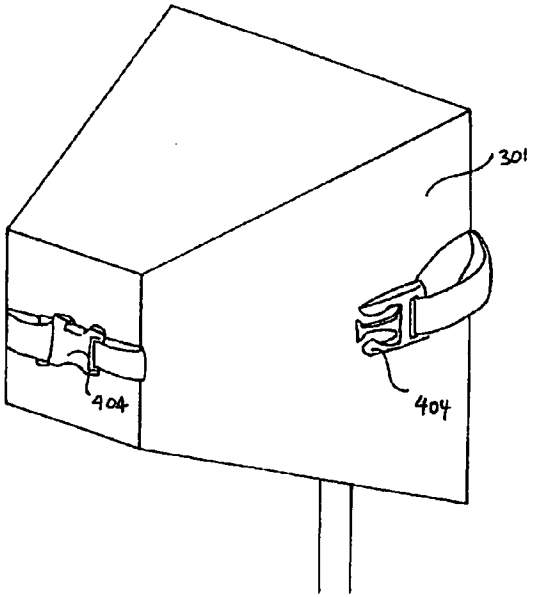
FIG. 4*c* is a perspective view of the system with connectors utilized therewith.

Referring now to FIG. 4*b*, a cross sectional side view of the assembled helical springlike antenna a collapsed state held with a holding device, one can see the compressed spring and compressed cover 301 in a storage position, taking little room or space, and being held close by a closing device 401, which may simply be a strap of fabric, held in place onto backplane 105 using snap connectors 403. Further, FIG. 4*c* shows how buckles 404 or hook and loop fasteners may be utilized. In instances where tip cap 109 is present in the assembly, a string (not shown) may be attached centrally to the center of the tip cap 109 and threaded through a hole (also not shown) in backplane 105, as a way to further compress and hold the assembly in a convenient, light manner.

Figure 5:
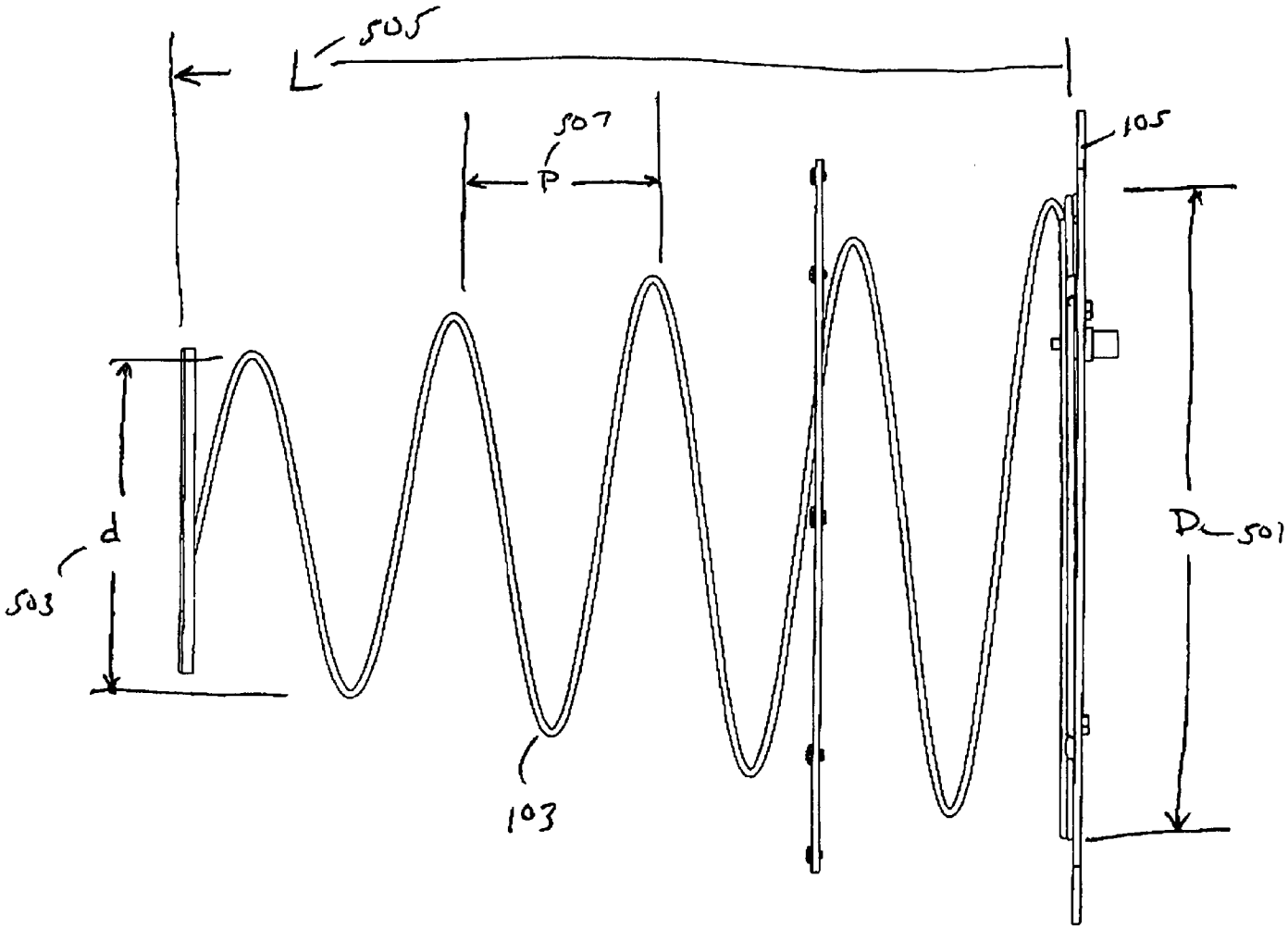
FIG. 5 is a side elevational view, similar to FIG. 2*a*, showing dimensional relationships of the helical antenna.

Referring now to FIG. 5, usable dimensions are suggested for operation in the 450 MHz to 700 MHz or UHF range. The fabric cover from FIG. 1, number 301 is not shown though it should be understood that FIG. 5 is intended to show the spring 103 in its operating, dimensionally stable and compressed state. Returning to FIG. 5, the diameter of the spring is generally proportional to the wavelength of the radio energy to be received. In this case "D" 501 is about 12", "d" 503 is about 6.5", "L" is about 16" and pitch "p" 507 may be around 5". Backplane may be about 1.2 times the wavelength and therefore may be about 14" square, but it can also be made as a circle or as a hexagon etc. if desired. Lower frequency operation can be afforded by enlarging the dimensions, and higher frequency operation can be afforded by making the dimensions smaller.

What has thus been shown is a superior helical antenna structure with low mass and light weight, and made of components that perform in tension and compression together to help define the length or dimension when deployed. The principles of this invention thus described and well understood by those with ordinary skill in the art will appreciate applications to very wide frequency ranges. High frequency, VHF, UHF and microwave sized constructions are possible by scaling the assembly.

The invention claimed is:

1. A helical, circularly-polarized antenna assembly having a directional characteristic, comprising a backplane, a compression spring-form helical radiator of longitudinally tapered configuration, and a tensioned cover, whereby the tensioned cover is effective to compress and limit the spring-form tapered helical radiator to a tapered predetermined position during use.

2. The helical, circularly-polarized antenna of claim 1, wherein said compressive cover is a fabric cover.

3. The helical, circularly polarized antenna of claim 1, wherein antenna assembly may be further compressed manually from the stable compressed state to a compact storage state.

4. The helical, circularly polarized antenna assembly of claim 1 wherein said tapered compression spring form radiator is storable in a generally flat configuration.

5. The helical, circularly polarized antenna assembly of claim 4, wherein said assembly has an operating frequency of between 450 and 700 MHz.

6. A feedpoint arrangement for the mechanically flexible attachment and impedance matching of a helical, longitudinally tapered, circularly polarized antenna above a fixed backplane, comprising; an extended end of a longitudinally tapered coil form defining the radiating element held at various inclined positions relative to said fixed backplane, an insulating sleeve coaxially positioned over said extended end, and, a first open flexible sleeve coaxially positioned over said insulating sleeve, and a fixed radiofrequency feedpoint attached to a second end of said flexible sleeve.

7. The feedpoint arrangement of claim 6 wherein said sleeve is a braided sleeve.

8. The feedpoint arrangement of claim 6 wherein said mechanically flexible attachment maintains electrical continuity throughout its range of motion.

9. The feedpoint arrangement of claim 6 wherein the various inclined positions are accomplished by a first predetermined stable operating position, and a second manually compressed state.

10. A helical, longitudinally tapered, circularly-polarized antenna assembly having a directional characteristic, comprising a backplane, a compression spring-form helical radiator of longitudinally tapered configuration, and a tensioning device, whereby the tensioning device is effective to limit the tapered spring-form helical radiator to a predetermined position during use.

11. The helical, longitudinally tapered, circularly-polarized antenna assembly as recited in claim 10, wherein the tensioning device is a flexible cover of truncated cone shape.

12. The helical, longitudinally tapered, circularly-polarized antenna assembly as recited in claim 11, wherein the longitudinally tapered antenna is collapsible from an elongated configuration into a generally flat configuration enabled by its longitudinally tapered, spiral shape.

* * * * *